United States Patent [19]

Ogle

[11] 4,286,389

[45] Sep. 1, 1981

[54] APPARATUS AND METHOD FOR LYOPHILIZING ASEPTIC SUBSTANCES

[75] Inventor: Robert W. Ogle, Newport Beach, Calif.

[73] Assignee: IMS Limited, South El Monte, Calif.

[21] Appl. No.: 126,198

[22] Filed: Mar. 3, 1980

[51] Int. Cl.[3] ..... F27B 5/06

[52] U.S. Cl. ..... 34/5; 215/307; 215/364

[58] Field of Search ..... 34/5, 92; 215/307, 355, 215/358, 364

[56] References Cited

U.S. PATENT DOCUMENTS

| | | | |
|---|---|---|---|
| 649,012 | 5/1900 | Tapscott | 34/92 |
| 718,659 | 1/1903 | Ruffin | 215/364 |
| 3,247,995 | 4/1966 | Jensen | 215/307 |
| 3,338,447 | 8/1967 | Meyers, Jr. | 215/358 |
| 3,578,195 | 5/1971 | Ogle | 215/307 |
| 3,795,986 | 3/1974 | Sutherland et al. | 34/5 |
| 3,834,571 | 9/1974 | Bartell | 215/307 |
| 4,193,402 | 3/1980 | Rumpler | 34/5 |

*Primary Examiner*—John J. Camby

*Attorney, Agent, or Firm*—Joseph E. Mueth

[57] ABSTRACT

Apparatus for use in lyophilizing a substance in a container and sealing the substance within the container after lyophilization. The apparatus includes an upper portion positionable about a resilient stopper in frictional engagement therewith, and a structure supporting the upper portion. The supporting structure is positionable on the open end of the container to space the upper portion and the stopper axially therefrom and define at least one fluid path communicating with the interior of the container. The upper portion and the supporting means may define an axial passageway for conducting the stopper from the initial position to a sealing position at least partially within the open end of the container upon application of an axial force to the stopper.

13 Claims, 5 Drawing Figures

FIG.—1
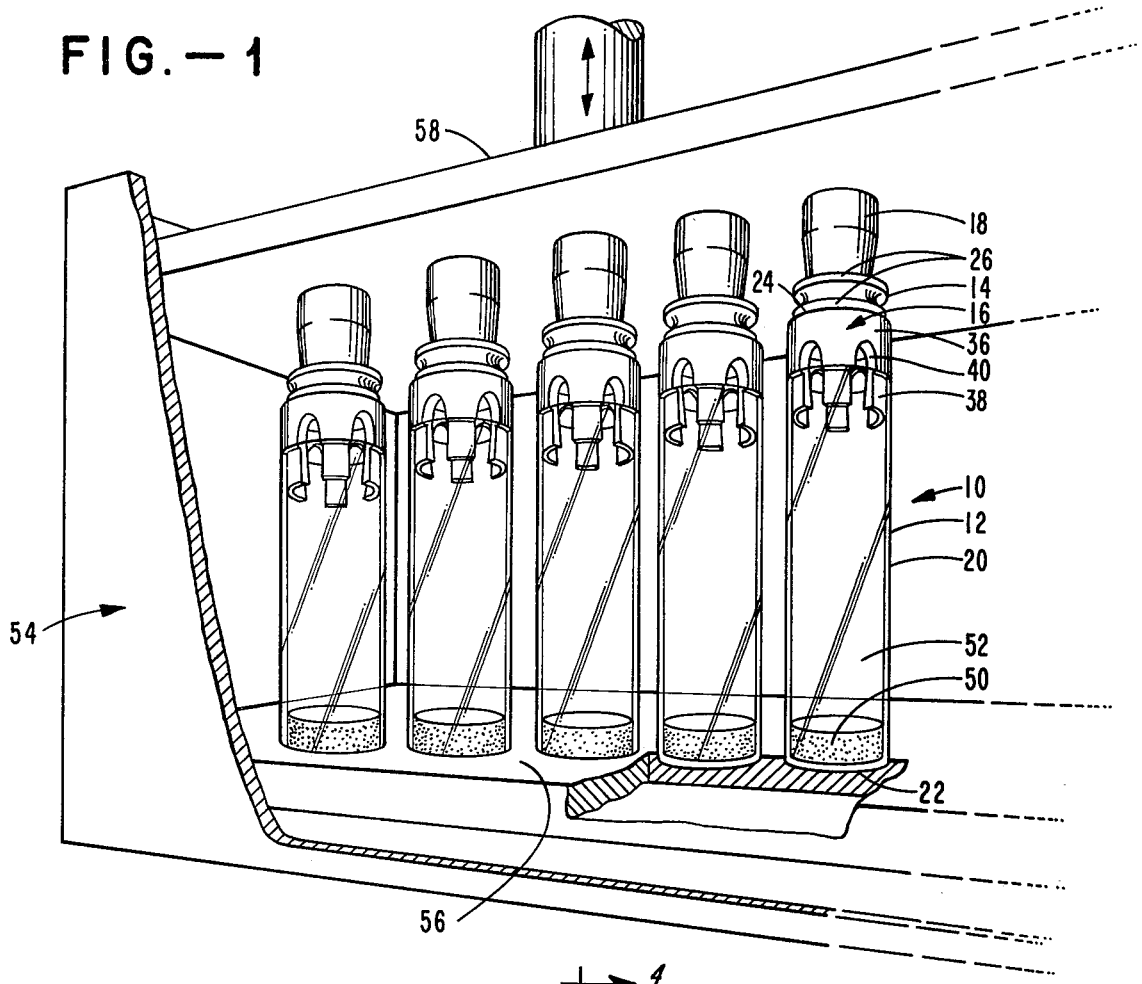
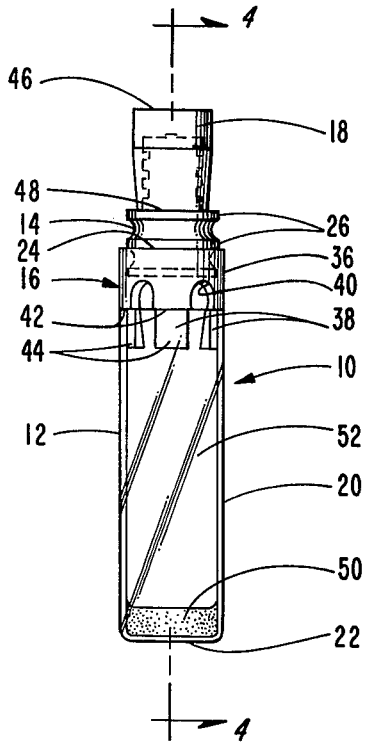
FIG.—3

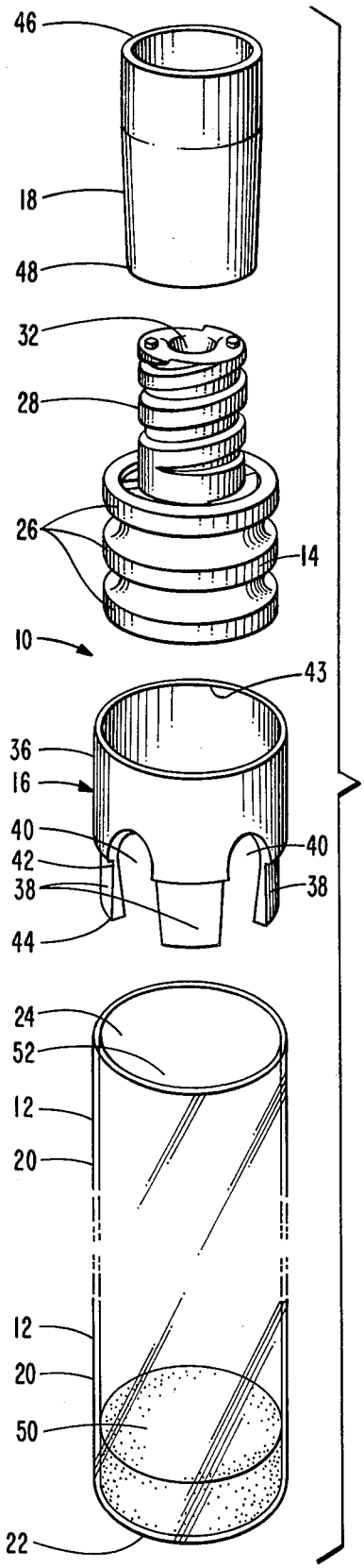
FIG.-2
FIG.-4
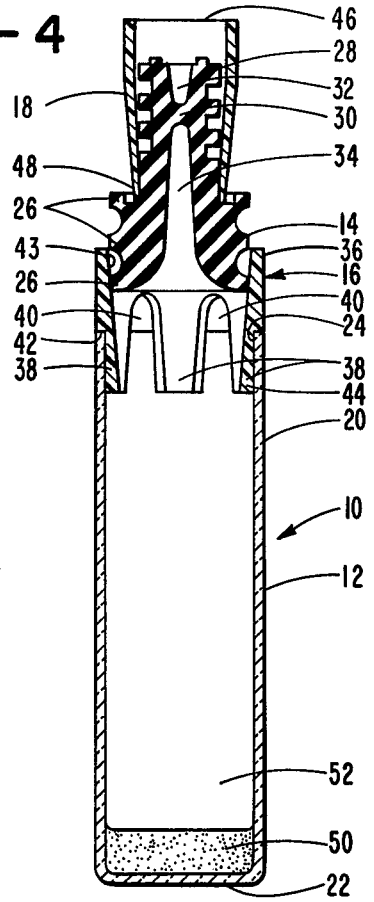
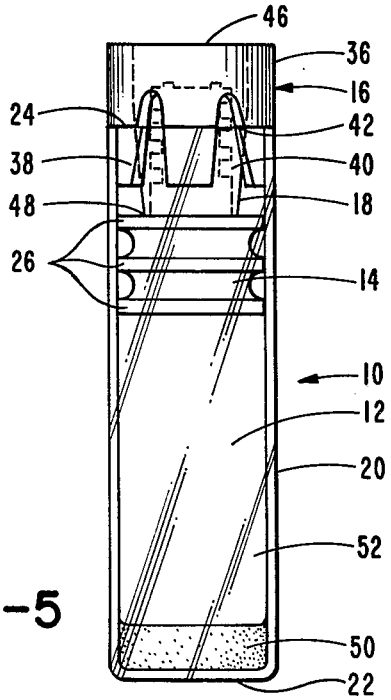
FIG.-5

APPARATUS AND METHOD FOR LYOPHILIZING ASEPTIC SUBSTANCES

BACKGROUND OF THE INVENTION

This invention relates to the lyophilization art and more particularly to an improved apparatus and method for maintaining communication with the interior of a container during lyophilization and providing for the sealing of the container thereafter.

Certain kinds of drugs must be lyophilized to avoid deterioration during moderate or long-term storage. Lyophilization, also known as freeze drying, involves removing the water from a substance by sublimation to produce a crystalline solid. When a substance is lyophilized in a vial or other container, provision must be made for water vapor to escape from the container. When aseptic substances are involved, it is also important that the container be promptly sealed to prevent contamination of the lyophilized product. To accomplish these purposes, lyophilization is often conducted in a closed environment wherein a plurality of vials containing the substance to be dried rest atop a cooling plate. Each vial is provided with a stopper partially received within an upwardly directed open end, the stoppers being provided with cross-holes or passages extending between openings on the side and base of the stopper, respectively. The openings on the side of the stopper are positioned to be exposed when the stoppers are in the initial partially inserted condition. Communication is thus initially provided between the interiors of the containers and the atmosphere within the lyophilizer. In this condition, the process of lyophilization takes place with the water vapor escaping from the vials through the cross-holes. After lyophilization, a horizontal top plate or ram is actuated downwardly against the stoppers to drive them into the vial to a second sealing condition.

The use of stoppers having cross-holes carries with it a number of disadvantages. Initially, the holes are relatively expensive to produce, adding to the total cost of the medication or other substance packaged in the vial. The holes also reduce the sealing capability of the stoppers, raising questions as to the adequacy of the assembled package to keep out contamination. Therefore, in many applications, it is desirable to provide an improved apparatus and method for maintaining communication with the interior of a vial during lyophilization of a substance within the vial and positively sealing the vial when lyophilization is complete.

SUMMARY OF THE INVENTION

Briefly, the present invention comprises a device for suspending a resilient stopper relative to a container having an open end during lyophilization of the substance within the container, comprising an upper portion positionable about the stopper in frictional engagement therewith; and means for supporting the upper portion, the supporting means being positionable on the open end of the container to space the upper portion and the stopper axially therefrom and defining at least one fluid path communicating with the interior of the container; whereby the stopper can be maintained in a first position permitting communication with the interior of the container. The upper portion and the supporting means may define an axial passageway for conducting the stopper from the first position to a second sealing position at least partially within the open end of the container upon application of an axial force to the stopper.

The supporting means may comprise a plurality of legs depending from the upper portion, and the fluid path may comprise the space between the legs. The device may include radial shoulders on the outer surface of the legs and spaced a predetermined distance from the ends thereof, such that the ends of the legs are received within the open end and the shoulders abut the container adjacent the open end for the supporting means positioned on the container.

The device may include an elongated drive element positionable on the outer end of the stopper to enable the stopper to be actuated axially through the upper portion and the supporting means to the second position by a plate or other ram element moved toward the upper portion. The elongated drive element may be generally cylindrical and receivable on an axial projection of the stopper, with the exterior surface of the drive element tapered.

It is an object of the present invention to provide an improved apparatus and method for permitting water vapor to escape from a vial during lyophilization of its contents and for easily sealing off the interior of the vial thereafter.

It is another object of the present invention to provide a simple and economical apparatus and method for lyophilizing and packaging aseptic substances.

It is a further object of the present invention to provide an apparatus and method for effectively sealing a vial from contamination after lyophilization of its contents.

The device of the present invention for suspending a resilient stopper relative to a container having an open end is highly advantageous in that it permits use of a stopper having no cross-holes. The spacing of the stopper itself from the open end of the vial or other container, in combination with the provision of at least one fluid path through the supporting means to the interior of the container, enables the water vapor produced during lyophilization to freely exit the container. The unique frictional engagement between the upper portion and the stopper for supporting the stopper in the desired position enables the stopper to be driven axially from that position to a sealing position within the container. The simple motion used in the prior method of seating stoppers with cross-holes is maintained in the present apparatus and method without the disadvantages of the holes. The formation of the supporting means as a plurality of legs with the fluid path comprising a space between the legs yields a device which is extremely economical to manufacture and tremendously effective for the intended purpose. The radial shoulders on the outer surfaces of the legs provide positive support for the device as the stopper is driven home to the sealing position. The ends of the legs received within the open end of the container serve to provide the device and the stopper with lateral stability, while permitting the resilient stopper to be forced therepast.

The tapered cylindrical drive element provides an extended axial reach to the plate or ram which drives the stopper home, enabling the stopper to be fully seated within the container despite the presence of the suspending device. The taper enables the drive element to at all times clear the suspending device.

BRIEF DESCRIPTION OF THE DRAWINGS

The above and other objects of the present invention may be more fully understood from the following detailed description, taken together with the accompanying drawings wherein similar reference characters refer to similar elements throughout and in which:

FIG. 1 is a somewhat diagrammatic perspective view of a lyophilizer containing a plurality of vial assemblies constructed in accordance with the present invention;

FIG. 2 is an exploded view of one of the vial assemblies illustrated in FIG. 1;

FIG. 3 is a front elevational view of the assembly shown in FIG. 2 with the stopper in the initial unseated position;

FIG. 4 is a vertical sectional view of the assembly shown in FIG. 3; and

FIG. 5 is a front elevational view of the assembly shown in FIG. 3, with the stopper in the seated condition.

DESCRIPTION OF THE PREFERRED EMBODIMENTS

Referring now to the drawings, there is illustrated, in FIGS. 1, 2, 3, 4 and 5 thereof, a vial assembly constructed in accordance with the present invention, generally designated 10. The vial assembly 10 generally comprises a cylindrical vial 12, an imperforate resilient stopper 14, a suspending device 16 and a drive sleeve 18.

The vial 12 is a generally cylindrical container having side walls 20, an end wall 22, and an upwardly directed open end 24. The stopper 14 is provided with a plurality of outer rings 26 for sealing against the interior of the vial 12, and with an upwardly directed threaded projection 28. As shown in FIG. 4, a relatively thin membrane-line portion 30 of the stopper 14 separates upwardly and downwardly extending cavities 32 and 34, respectively, to make the stopper 14 imperforate and at the same time pierceable along its axis by a hollow needle or other instrument.

The suspending device 16 includes a generally cylindrical upper portion 36 having a plurality of legs 38 depending therefrom to form scallop-shaped openings or slots 40. The outside diameter of the suspending device 16 is essentially constant along the length of the upper portion 36 and part of the legs 38, but is provided with a step-down or shoulder 42 on the legs 38 a predetermined distance from the ends thereof. The stepped-down outside diameter of the device 16 is substantially equal to the inside diameter of the vial 12, enabling the portions of the legs 38 below the step 42 to be snugly received within the vial 20. In this condition, the device 16 is supported by the open end 24 of the vial engaging the step 42 of the device. The bore 43 of the device 16 is tapered toward the lower ends 44 of the legs 38, with the legs increasing somewhat in thickness toward the lower ends 44. The device 16 is thus thinnest at the points on the legs 38 directly beneath the step 42, allowing the legs 38 to be deflected inwardly a small distance about those points to facilitate insertion of the legs into the open end 24 of the vial.

The drive sleeve 18 is a generally cylindrical elongated element receivable on the upward projection 28 of the stopper 14 to facilitate driving the stopper axially into the vial 12. The sleeve 18 fits loosely about the projection 28 and is provided with an exterior surface which tapers down from an upper end 46 to a lower end 48.

The components of the vial assembly 10 are initially assembled as shown in FIGS. 3 and 4, with an aseptic substance 50 within the vial 12. The stopper 14 is inserted downwardly into the tapered bore 43 of the suspending device 16 in a force-fit relationship, to a point at which the stopper is held securely in position by the device 16 while the scallop-shaped openings 40 remain unobstructed. The suspending device 16 is then placed on top of the vial 12 such that the lower portions of the legs 38 extend into the vial and the step 42 abuts the vial at the open end 24. The drive sleeve 18 is fitted over the upward projection 28 of the stopper 14 with the lower end 48 contacting the stopper. In this condition, the stopper 14 is held in coaxial alignment directly above the open end of the vial 12 while communication is maintained between the atmosphere and the interior 52 of the vial. When it is desired to seal off the interior 52, a downward force is applied to the drive sleeve 18 in the direction indicated in FIG. 3. This force actuates the stopper 14 downwardly through the tapered bore 43 of the suspending device 16, causing the stopper to be compressed to a diameter less than the inside diameter of the vial 12, and finally to exit the lower end of the bore 43 and assume the position shown in FIG. 5. At this point, the upper end 46 of the drive sleeve 18 is aligned with the upper end of the suspending device 16, and the stopper 14 is in the desired position within the vial. The downward force can be applied with a plate or other flat member. The drive sleeve 18 is a convenient element for the application of force to the stopper 14 and provides the additional reach required for setting the stopper 14 to the intended location within the vial. In the condition of FIG. 5, the interior 52 is completely sealed off from the environment and is accessible for use only through the relatively thin portion 30 of the stopper 14.

The use of the vial assembly 10 in the lyophilization of aseptic substances is most clearly understood in relation to FIG. 1, which illustrates a plurality of vial assemblies within a conventional lyophilizer 54. The lyophilizer 54 includes a chamber having a bottom surface element 56 able to expose the vial assemblies 10 to very low temperatures. The surface element 56 may also be provided with a heating apparatus for raising the temperature of the vial assemblies 10. The vial assemblies rest on the surface element 56 in the initial assembled condition shown in FIG. 3. The surface element 56 is then caused to rapidly cool the vial assemblies, lyophilizing or freeze-drying the contents 50 of the vial assemblies. In this process, the water within the substances 50 passes from the substances by sublimation and exits the vial assemblies through the scallop-shaped openings 40. When lyophilization is completed, the substances 50 are left in the form of crystalline solids which are storable for long periods of time without degradation. The vials 12 are sealed without the introduction of impurities by a horizontal plate or ram element 58 actuated downwardly against the drive sleeves 18 to actuate the stoppers 14 to the sealing position shown in FIG. 5. At this point, each of the vials 12 is positively sealed from the atmosphere and suitable for the long-term storage of the lyophilized substances 50. The lyophilizer 54 can thus be opened by an operator and the vials removed therefrom. The suspending devices 16 and the drive sleeves 18 are removed from the vials 12 at this time, and may be reused on an indefinite basis in future lyophilization procedures.

In operation, a great number of vials 12 are assembled to form vial assemblies 10 and are arranged in a relatively closely packed configuration within the lyophilizer 54. The lyophilizer may be effectively isolated from the atmosphere to prevent contamination of the substances 50 being lyophilized, and the use of the plate 58 to seat the stoppers 14 enables the entire lyophilization process to take place without human intervention. A rack or other supporting structure (not shown) can be used to support the vial assemblies 10 during lyophilization and the seating of the stoppers 14.

The vials 12 are preferably constructed of a suitable glass or plastic material while the suspending devices 16 and the drive sleeves 18 are preferably made of a semi-rigid nylon or other suitable material. The stoppers 14 are made of rubber or a resilient rubber-like material. The stoppers 14 are thus readily deformable relative to the supporting device 16 and the vial 12, allowing the stopper to be easily forced through the tapered bore of the suspending device without damage and to provide an effective seal with the interior of the vial 12.

It will be understood that the vials 12 may be non-cylindrical in shape and the stoppers 14 need not embody the precise configuration illustrated herein. The present invention is applicable to containers having cylindrical necks and, most generally, to containers having stoppered openings of virtually any type. The stopper 14 having an upwardly directed threaded projection 28 is also shown by example only, and is suitable for use in a particular type of unit dose emergency medication system. Alternatively, the stopper 14 can have a projection shaped somewhat differently than the projection 28 or may have no projection at all.

From the above, it can be seen that there has been provided an improved apparatus and method for lyophilizing aseptic substances located within containers having open ends sealable by resilient stoppers. Communication with the interior of the containers may be easily and inexpensively maintained during the lyophilization process, with the stoppers easily actuable into a sealing position within the openings of the containers after lyophilization has been completed.

The appended claims are intended to cover all variations and adaptations falling within the true scope and spirit of the present invention.

I claim:

1. A device for suspending a resilient stopper relative to a container having an open end during lyophilization of a substance within the container, comprising:

an upper portion positionable about the stopper in frictional engagement therewith; and means for supporting the upper portion, said supporting means comprising a plurality of spaced legs depending from the upper portion and having downwardly facing shoulders engageable in abutting relationship with the open end of the container to space the upper portion and the stopper axially therefrom and provide a fluid path between the legs to the interior of the container;

whereby the stopper can be maintained in a first position spaced from the open end of the container to permit fluid communication with the interior of the container.

2. The device recited in claim 1 wherein said upper portion and said supporting means define an axial passageway for conducting the stopper from said first position spaced from the open end of the container to a second sealing position beneath the device and within the open end of the container, upon application of an axial force to the stopper.

3. The device recited in claim 2 wherein the legs terminate in respective lower ends, said shoulders being located on the outer surfaces of said legs at a predetermined distance from the lower ends such that the lower ends are receivable within the open end of the container.

4. The device recited in claim 3 wherein said axial passageway is tapered to compress the stopper as it is conducted toward said second sealing position.

5. The device recited in claim 4 which includes a hollow elongated drive element smaller in diameter than the stopper and receivable over an upwardly directed projection of the stopper to permit actuation of the stopper axially through the upper portion and the supporting means to said second position within the container by a substantially flat ram element.

6. The device recited in claim 5 wherein said elongated drive element is provided with a tapered exterior surface for reception within said axial passageway when the stopper is actuated toward said second sealing position.

7. Apparatus for use in lyophilizing a substance in a container having an open end and sealing the substance within the container after lyophilization, comprising:

a resilient stopper;

hollow means mountable coaxially to the open end of the container for suspending said resilient stopper in a first position spaced from the open end and permitting fluid communication with the interior of the container when the stopper is in said first position;

means for lyophilizing a substance within the container when the stopper is in said first position; and means for driving the stopper through said hollow suspending means from said first position to a second sealing position, said second position being beyond said hollow suspending means and within the open end;

such that communication with the interior of the container can be maintained during lyophilization and the container can thereafter be sealed.

8. Apparatus as recited in claim 7 wherein said hollow suspending means comprises:

an upper portion positionable about the stopper and frictionally engaged therewith in said first position of the stopper; and means for supporting the upper portion, said supporting means comprising a plurality of spaced legs depending from the upper portion and having downwardly facing shoulders engageable in abutting relationship with the open end of the container to space the upper portion and the stopper axially therefrom, said supporting means further defining at least one fluid path between said legs such that fluid communication with the interior of the container is permitted when the stopper is in said first position.

9. Apparatus as recited in claim 8 wherein the legs terminate in respective lower ends, said shoulders being located on the outer surfaces of said legs at a predetermined distance from said lower ends such that the lower ends are receivable within the open end of the container.

10. Apparatus as recited in claim 9 wherein said upper portion and said supporting means define a tapered axial passageway for conducting the stopper from said first position to said second sealing position.

11. Apparatus as recited in claim 9 wherein said driving means includes a hollow elongated drive element smaller in diameter than the stopper and receivable over an upwardly directed projection of the stopper, and a ram element having a substantially flat surface actuable toward said upper portion against the drive element to force the stopper axially through the suspending means to said second position.

12. Apparatus as recited in claim 11 wherein said elongated drive element is provided with a tapered exterior surface for reception of the drive element within said axial passageway when the stopper is actuated toward said second sealing position.

13. The method of lyophilizing a substance within a container having an open end sealable by an imperforate resilient stopper, which comprises:

frictionally retaining the stopper within a support element mounted to the open end of the container such that the stopper is spaced from the open end and fluid communication with the interior of the container is maintained;

lyophilizing the substance within the container while the stopper is retained within the support element; and driving the stopper from the support element into the open end to seal the container;

whereby communication with the interior of the container is maintained during lyophilization for escape of the vapor produced, and the container is thereafter sealed.

* * * * *